United States Patent [19]

Fraser, Jr. et al.

[11] Patent Number: 5,035,589

[45] Date of Patent: Jul. 30, 1991

[54] METHOD AND APPARATUS FOR REDUCING SCROLL COMPRESSOR TIP LEAKAGE

[75] Inventors: Howard H. Fraser, Jr., Lafayette; William J. Boonzha, Jordan, both of N.Y.; Shahrokh Etemad, Stratford, Conn.

[73] Assignee: Carrier Corporation, Syracuse, N.Y.

[21] Appl. No.: 465,375

[22] Filed: Jan. 16, 1990

[51] Int. Cl.[5] ..... F04C 18/04; F04C 27/00; F16J 15/447

[52] U.S. Cl. ..... 418/1; 418/55.2; 418/55.4; 418/141; 277/53; 277/96.1

[58] Field of Search ..... 418/1, 55.2, 55.4, 141; 277/53, 96.1; 29/888.022

[56] References Cited

U.S. PATENT DOCUMENTS

| | | | |
|---|---|---|---|
| 3,660,978 | 5/1972 | Hinckley | 418/141 |
| 3,965,697 | 6/1976 | Beierwaltes | 418/141 |
| 4,059,370 | 11/1977 | Gibson | 418/141 |
| 4,148,494 | 4/1979 | Zelahy et al. | 277/53 |
| 4,227,703 | 10/1980 | Stalker et al. | 277/53 |
| 4,411,605 | 10/1983 | Sauls | 418/141 |
| 4,420,162 | 12/1983 | Yanai et al. | 277/96.1 |
| 4,834,400 | 5/1989 | Lebeck | 277/96.1 |

FOREIGN PATENT DOCUMENTS

| | | | |
|---|---|---|---|
| 55-37515 | 3/1980 | Japan | 418/55.4 |
| 753772 | 8/1956 | United Kingdom | 418/141 |

*Primary Examiner*—John J. Vrablik

[57] ABSTRACT

Leakage in a scroll wrap compressor is reduced by providing a roughened scroll wrap tip surface at the gap between the tip and the cooperating base so as to increase the frictional resistance to flow of fluid through the gap and to cause turbulence within the gap to further increase the resistance to the flow of fluid from the high pressure to the low pressure side across a scroll wrap tip. Various types of surfaces are shown for increasing the frictional resistance to flow such as knurling, grooving, cast cavities, metal particles and fibers and the like.

2 Claims, 2 Drawing Sheets

METHOD AND APPARATUS FOR REDUCING SCROLL COMPRESSOR TIP LEAKAGE

BACKGROUND OF THE INVENTION

This invention relates to rotating pumps or compressors of the scroll type and more particularly to reducing leakage of the fluid being compressed across the tips of the scroll wraps in a scroll compressor.

Scroll type compressors have been known, in principle, for several decades. In general, a scroll-type compressor or similar machine comprises a pair of mating scrolls, each of which has an involute spiral wrap of similar shape, mounted on respective base plates. Normally, one scroll is held fixed, and the other is movable, to orbit but not rotate, about the axis of the fixed scroll, being held by an Oldham ring or other anti-rotating structure. The walls of the two involute wraps define crescent-shaped volumes which become smaller and smaller and move from the outside to the center of the mating scrolls as the orbiting scroll revolves. A compressible fluid, such as a refrigerant gas, can be introduced at the periphery of the spiral wraps, and is compressed as it is moved under the orbiting motion of the device. The compressed fluid is then discharged at the center. By introducing a compressed fluid at the center and permitting its expansion to drive the devices, the scroll machine can be used as a motor.

The orbiting motion of the moving scroll means that at the tip of the scroll wrap of both the orbiting and the stationary scroll there is a convoluted interface across which the fluid being compressed can leak from the high pressure side to the low pressure side of these devices. To minimize leakage at the scroll tip the devices have been manufactured with extremely tight tolerances but it still has been found desirable to modify the tip to further reduce leakage. The standard type O-ring material placed in a slot in the scroll wrap tips has been unsatisfactory for a number of reasons, principally swelling of the material and consequent loss of spring rate such that the sealing effectiveness of the material is lost or the material disintegrates and inhibits the orbiting action of the movable scroll.

As proposed in the copending application Ser. No. 461,759 assigned to the common assignee of this application previously filed on Jan. 8, 1990, a compound "C"-shaped cross section spring having an O-ring sealing core has been proposed as one method of reducing fluid leakage across the tip of the scroll wrap of the scroll compressor. For many applications, this type of scroll wrap tip seal works very effectively, however, for certain types of materials being compressed and for certain applications other leakage reducing means are preferred.

OBJECTS AND SUMMARY OF THE INVENTION:

Accordingly it is an object of the present invention to provide a method and apparatus for reducing scroll wrap tip leakage that does not require a seal.

It is another object of the present invention to reduce the fluid leakage across the scroll wrap tips of the fixed and orbiting scroll wraps of a scroll compressor.

It is a still further object of the present invention to provide a method and apparatus for restricting the leakage path across the scroll wrap tip of a scroll type compressor.

In accordance with the method of the present invention, a variety of restrictions of the leakage path across the scroll wrap tip are provided to inhibit and reduce the flow of fluid being compressed from the high pressure side of the scroll wrap to the low pressure side. Mechanical serration, cavities, fibers, and the like are provided in the scroll wrap tip surface to form a rough surface interface along which the fluid flow must travel in order to leak from the high to the low-pressure side. This surface inhibits the flow of fluid between the scroll wrap tip and the cooperative scroll base.

The above and other objects, features, and advantages of this invention will present themselves to those skilled in the art from a reading of the ensuing detailed description which is to be considered in connection with the accompanying Drawings.

DETAILED DESCRIPTION OF A PREFERRED EMBODIMENT

Figure 1:
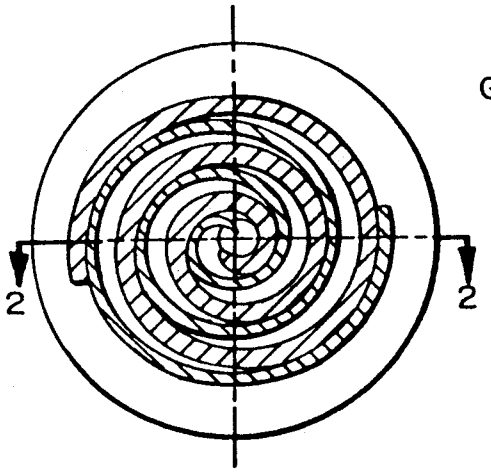
FIG. 1 is a sectional plan view of the fixed and movable scrolls of a typical scroll compressor.
Figure 2:
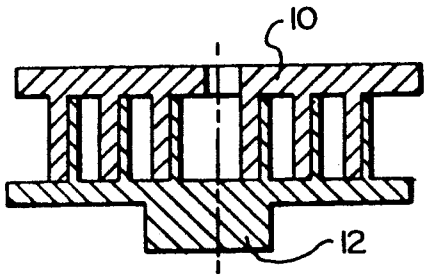
FIG. 2 is a cross sectional view taken on line 2—2 of FIG. 1.
Figure 3:
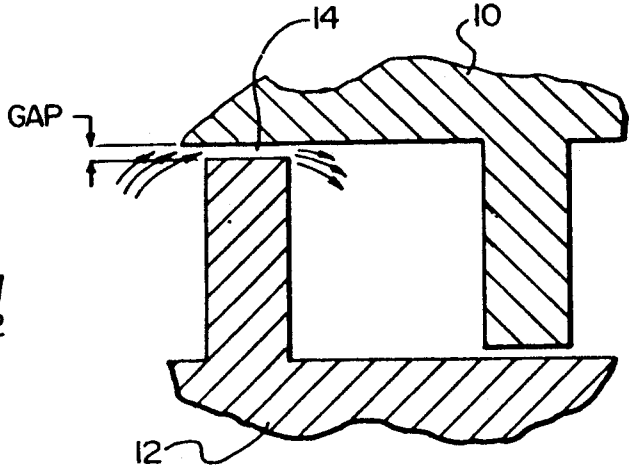
FIG. 3 is an enlarged partial cross sectional view of a pair of adjacent scroll wrap tips.

Referring now to FIGS. 1-3 there is shown a typical scroll wrap compressor of the type having a fixed scroll 10 and a movable scroll 12 which cooperate to form a convoluted cavity for compressing a fluid from the outer periphery to the center thereof. As it may be seen in FIG. 3, the tip of one scroll cooperates with the base of the other to form a restricted gap 14 through which and across which the fluid being compressed will try to leak from the high pressure side of the cavity to the lower pressure side throughout the length of the scroll wraps.

This gap 14 as seen in FIG. 3 is reduced as much as possible by precision construction of the parts of the scroll compressor but since one surface must move with respect to the other, some clearance will always inherently be present.

Applicants have discovered a method and means for inhibiting this leakage flow of the fluid being compressed so that the leakage can be substantially reduced through the gap 14 at each scroll wrap tip.

The fluid being compressed tends to try and flow through the gap 14 as shown in FIG. 3 over the normal flat base surface and tip surface of the conventional scroll wrap tip and base. It has been found that this flow can be greatly reduced by providing a rough surface on the scroll wrap tip that acts as a "friction" barrier to the flow of the fluid. By providing a plurality of impediments to the smooth flow of fluid, a severe turbulence is produced which creates in turn friction across the surface such that the flow of a given fluid is significantly reduced from the high to the low pressure cavities across the tip interface.

Figure 4:
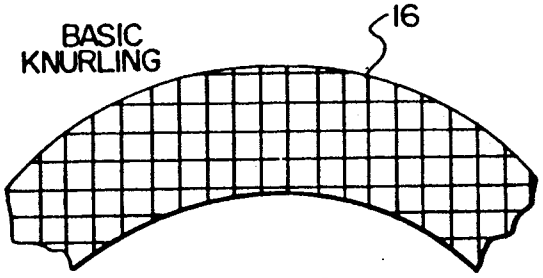
FIG. 4 is a partial top plan view of a scroll segment of a scroll wrap tip.
Figure 5:
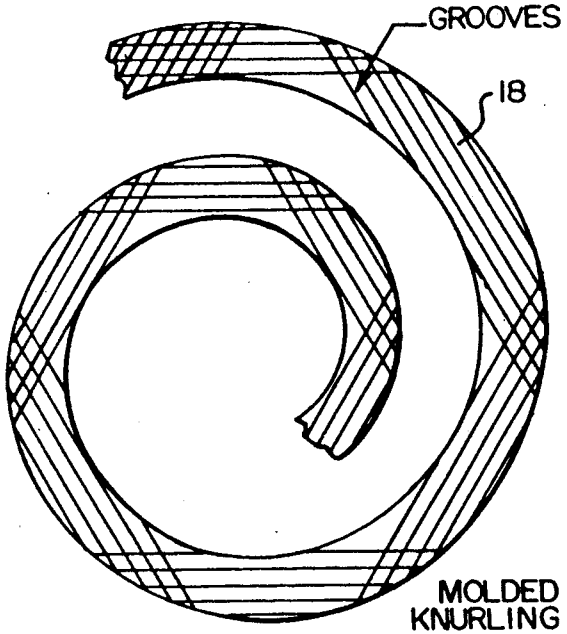
FIG. 5 is a top plan view of a portion of the surface of a scroll wrap tip according to the present invention.

For instance as shown in FIG. 4 a standard basic knurling 16 of the scroll wrap tip surface will significantly reduce the flow of fluid thereacross. In another version we have found that by cutting a series of grooves 18 in the scroll wrap tips, essential perpendicular to the direction of flow, greatly reduces the flow of the fluid. As may be seen in FIG. 5 the grooves 18 are generally perpendicular to a radius of the scroll and are constantly changed as they proceed around the periphery of the scroll. In this way, there is essentially a groove or turbulence and friction creating impediment to the flow of the fluid from the higher pressure cavity of the scroll to the lower pressure or outer side of the scroll.

Figure 8:
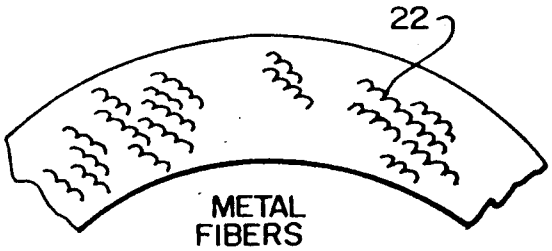
FIG. 8 is a view similar to FIG. 6 of another embodiment of the present invention.
Figure 6:
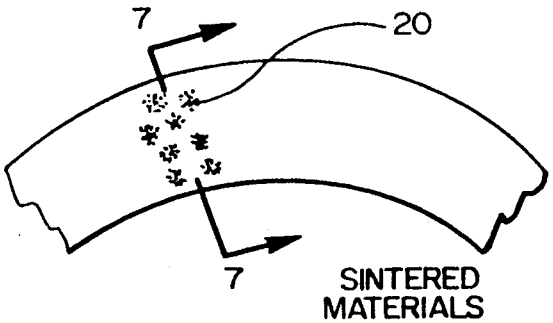
FIG. 6 is a view similar to FIG. 4 of another embodiment of the present invention.
Figure 7:
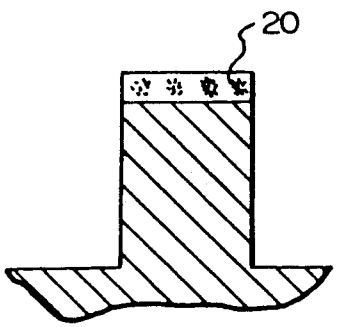
FIG. 7 is a cross sectional view taken on line 7—7 of FIG. 6.

Referring to FIGS. 6–8 it has been found that by applying a porous/fibrous metallic material to the surface of the scroll wrap tips, as indicated at 20 and 22, the flow of fluid across the scroll wrap tips is substantially reduced. The porous/fibrous metallic material creates a turbulence in the fluid and drag on the flow of fluid across the scroll wrap tip base interface.

The porous metallic material 20 of FIGS. 6 and 7 is spread uniformly across the surface of the scroll wrap tips to provide a thin porous layer of material throughout the tip/base interface. The metallic fibers 22 of FIG. 8 are randomly oriented across the tip surface to provide interference to the flow of fluid being compressed from the high pressure to the low pressure side of the scroll wrap tips.

The porous materials 20 and the plurality of randomly oriented metal fibers 22 are attached to the scroll wrap tips by any convenient means, such as a suitable adhesive, depending upon the specific material being used to coat the scroll wrap tips.

Figure 9:
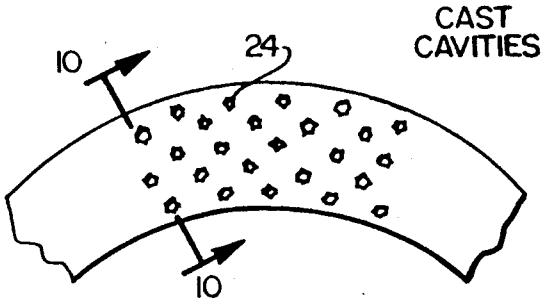
FIG. 9 is a view similar to FIG. 8 of a still further embodiment of the present invention.
Figure 10:
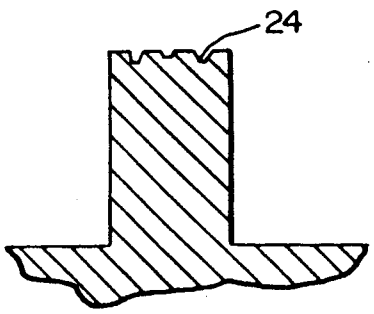
FIG. 10 is a cross sectional view taken on line 10—10 of FIG. 9.

In FIGS. 9 and 10 there is shown another form of our invention in which small minute cavities 24 are cast into the tip of the scroll wrap member to provide a series of mechanisms for frictionally slowing down the flow of fluid and for causing turbulence within the fluid to further increase the frictional forces resisting the transit of fluid from the high pressure side to the low pressure side. As may be seen in FIG. 10 these cavities can take a variety of forms, spacings, and are randomly oriented so as to produce the maximum in turbulence and frictional resistances to smooth leakage flow of the fluids being compressed by the scroll compressor.

While a variety of types of means have been shown for increasing the frictional flow of the fluid and creating turbulence and internal friction within the fluid the concept is basically the same. Each type has particular advantages for specific fluids and specific types of scroll wrap tips taking into account the pressures that one desires to achieve, the materials being used, the velocity of motion of one scroll relative to the other and so forth. It has been found that with materials such as shown in FIGS. 6 and 8 the metal to metal contact of the scroll wrap tip with the cooperating scroll wrap base will tend to abrade the surface of the scroll wrap tips so as to provide the best possible flow inhibiting characteristics for the porous material.

We have thus provided a method and apparatus for reducing the flow of fluid being compressed across the scroll wrap tips by modifying the surface of the scroll wrap tip so as to greatly increase the frictional resistance to the flow of fluid thereacross and to create internal turbulence so as to slow down the flow and inhibit the leakage of fluid through the gap between the tip and cooperating base.

While this invention has been described in detail with reference to preferred embodiments, it should be understood that the invention is not limited to any one of the precise embodiments, but rather many modifications and variations will present themselves to those of skill in the art without departing from the scope and spirit of this invention as defined in the appended claims.

What is claimed is:

1. A scroll compressor for compressing fluids of the type including a shell which contains a fixed scroll and an orbiting scroll which is disposed off the axis of the fixed scroll for revolving about the axis of the fixed scroll, rotation-prevention means for holding the orbiting scroll against rotation but permitting it to revolve in an orbiting motion, drive means mounted within the shell for driving said orbiting scroll in its orbiting motion, wherein the improvement comprises a plurality of linear grooves formed sequentially along the scroll wrap tip, at least a portion of each groove intersecting a portion of an adjacent groove said grooves being disposed around the periphery of the scroll wrap substantially at right angles to the direction of leakage flow across the scroll wrap tips of the fluid being compressed, so that the leakage of the fluid being compressed across the scroll tips from high to low pressure sides is reduced.

2. In a scroll compressor for compressing fluids of the type having a fixed and an orbiting scroll each of which has an involute spiral wrap of similar shape mounted on respective base plates for cooperative mating relationship with a gap between the tip of each scroll and its cooperating base plate through which fluid tends to leak, from the high pressure side to the low pressure side of the scroll wrap; the method of reducing leakage across the tips of the scrolls from the higher pressure cavities to the lower pressure cavities which comprises:

physically forming a plurality of shallow linear grooves in the surface of the scroll wrap tips, choosing the length of said grooves to cause the grooves to overlap adjacent linear grooves at each end in a criss-crossed fashion; and forming said grooves with the central portion of said grooves generally perpendicular to the direction of leakage flow across the scroll wrap tips to increase frictional resistance to flow, of the fluid being compressed through the gap between the scroll tip and cooperating base.

* * * * *